US011643176B1

(12) United States Patent
Mueller et al.

(10) Patent No.: US 11,643,176 B1
(45) Date of Patent: May 9, 2023

(54) HULL ASSEMBLY FOR A PONTOON BOAT

(71) Applicant: Brunswick Corporation, Mettawa, IL (US)

(72) Inventors: Eric S. Mueller, Fond du Lac, WI (US); Daniel J. Balogh, Menasha, WI (US); Wayne M. Jaszewski, Jackson, WI (US)

(73) Assignee: Brunswick Corporation, Mettawa, IL (US)

( * ) Notice: Subject to any disclaimer, the term of this patent is extended or adjusted under 35 U.S.C. 154(b) by 133 days.

(21) Appl. No.: 17/231,262

(22) Filed: Apr. 15, 2021

(51) Int. Cl.

| | |
|---|---|
| ***B63B 35/38*** | (2006.01) |
| ***B63H 11/00*** | (2006.01) |
| ***B63B 1/12*** | (2006.01) |
| ***B63H 21/21*** | (2006.01) |

(52) U.S. Cl.
CPC ..... *B63B 35/38* (2013.01); *B63B 1/121* (2013.01); *B63B 1/125* (2013.01); *B63H 11/00* (2013.01); *B63H 21/21* (2013.01); *B63H 2011/008* (2013.01)

(58) Field of Classification Search
CPC ..... B63B 35/38; B63B 1/121; B63B 1/125; B63H 11/00; B63H 21/21
See application file for complete search history.

(56) References Cited

U.S. PATENT DOCUMENTS 3,236,202 A * 2/1966 Quady ..... B63B 1/12 114/61.1
5,595,133 A * 1/1997 Bullard ..... B63C 11/49 114/66
6,257,165 B1 * 7/2001 Danos, Jr. ..... B63B 35/44 405/196
7,182,033 B1 * 2/2007 Phillips ..... B63B 1/12 114/248
7,185,599 B1 * 3/2007 Griffiths ..... B63B 1/12 114/263
7,533,622 B1 * 5/2009 Jaszewski ..... B63H 5/125 114/248
7,806,065 B1 * 10/2010 Bekker ..... B63H 5/125 440/6
8,123,577 B2 * 2/2012 Riggs ..... H01M 12/06 440/6

(Continued)

FOREIGN PATENT DOCUMENTS

GB 2554045 A 3/2018

OTHER PUBLICATIONS

Kraus et al., "Stowable Marine Propulsion Systems," Unpublished U.S. Appl. No. 17/185,289, filed Feb. 25, 2021 (specification and drawings only).

(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A hull assembly for a pontoon boat includes a hull extending in a longitudinal direction between a front end and a rear end. A first thruster assembly is attached to a first lateral side of the hull. A second thruster assembly is attached to a second lateral side of the hull. The first and second thruster assemblies include respective thrust units that are each movable between a deployed position and a stowed position.

20 Claims, 5 Drawing Sheets

(56) References Cited

U.S. PATENT DOCUMENTS

| | | | | |
|---|---|---|---|---|
| 8,814,616 | B2 * | 8/2014 | Riggs | H01M 16/006 440/6 |
| 9,108,710 | B1 * | 8/2015 | McChesney | B63B 35/613 |
| 10,407,131 | B1 * | 9/2019 | Ward | B63B 17/00 |
| 2006/0228959 | A1 | 10/2006 | Ruiz | |
| 2008/0190227 | A1 * | 8/2008 | Myers | B63H 20/08 74/22 R |
| 2012/0097086 | A1 * | 4/2012 | Sancoff | F42B 10/42 440/49 |
| 2014/0158037 | A1 * | 6/2014 | George | B63H 5/08 114/283 |
| 2015/0201548 | A1 * | 7/2015 | Wolter | B01F 33/5021 366/270 |
| 2015/0259033 | A1 | 9/2015 | George et al. | |
| 2017/0203823 | A1 * | 7/2017 | Abney | B63H 25/42 |
| 2019/0217921 | A1 * | 7/2019 | Shibayama | B63H 11/08 |
| 2021/0354803 | A1 * | 11/2021 | Christensen | B60L 53/20 |
| 2021/0380210 | A1 * | 12/2021 | Fishburn | B63B 35/38 |
| 2022/0266968 | A1 * | 8/2022 | Perdomo Tornbaum | B63B 35/613 |

OTHER PUBLICATIONS

Tornbaum, Andres Perdomo, "Methods for a Marine Vessel with Primary and Auxiliary Propulsion Devices," Unpublished U.S. Appl. No. 16/984,617, filed Aug. 4, 2020 (specification and drawings only).

Powerboat Television, "How to make docking a pontoon boat easy with a retractable SideShift Thruster 1 My Boat DIY", YouTube video, Jun. 1, 2020, available at https://www.youtube.com/watch?v=2NBx-VnI3Kk.

Sideshift Inc., "Sideshift Dock Like a Pro PT230/PT360 Pontoon Thruster System," Installation/Operation Manual, Oct. 2019, vol. 2.4.

* cited by examiner

HULL ASSEMBLY FOR A PONTOON BOAT

FIELD

The present disclosure relates to propulsion of pontoon boats using thrusters.

BACKGROUND

U.S. Pat. No. 7,182,033 discloses a self-contained marine propulsion device disposed within a container, or pod, that is removably attachable to an undersurface of a deck of a pontoon boat. An engine is contained within the container and connected in torque transmitting relation with the marine propulsion device which can be a sterndrive device or a jet drive device. The marine propulsion system is dirigible, with a portion that is rotatable about a generally vertical steering axis and is supported by the container which is attached to the deck of the pontoon boat.

U.S. Pat. No. 7,185,599 discloses a pontoon boat provided with a jet drive propulsion system in which an impeller is driven by an engine. The jet drive propulsion device is dirigible as a result of the fact that a nozzle of the device is rotatable about a generally vertical steering axis. The jet drive device can be supported below a deck of a pontoon boat and located between two flotation tubes of the pontoon boat. Alternative locations can also be used, such as within the structure of the flotation tubes themselves.

U.S. Pat. No. 7,533,622 discloses a container, or pod, for a pontoon boat in which an engine is disposed within the container and the container is supported below the deck surface of the pontoon boat. The container is shaped to prevent its passing completely downwardly through an opening in the deck surface when it is assembled from a position above the deck. A marine propulsion device is connected to the engine which is located within the pod, or container, and extends from the container when the container and the marine propulsion device are supported below the deck of the pontoon boat.

The above patents are incorporated herein by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example, a hull assembly for a pontoon boat includes a hull extending in a longitudinal direction between a front end and a rear end. A first thruster assembly is attached to a first lateral side of the hull. A second thruster assembly is attached to a second lateral side of the hull. The first and second thruster assemblies include respective thrust units that are each movable between a deployed position and a stowed position.

In another example, a hull assembly for a pontoon boat includes a hull extending in a longitudinal direction between a front end and a rear end. A first thruster assembly is attached to a first lateral side of the hull closer to the front end of the hull than the rear end of the hull. The first thruster assembly includes a first shaft, a first joint coupling the first shaft to the hull in a movable manner, a first thrust unit attached to the first shaft, and a first actuator configured to move the first shaft and the first thrust unit with respect to the hull via the first joint. The first actuator is configured to move the first shaft and the first thrust unit between a stowed position, in which the first thrust unit is located alongside the first lateral side of the hull, and a deployed position, in which the first thrust unit is located below a bottom surface of the hull.

BRIEF DESCRIPTION OF THE DRAWINGS

Examples of a pontoon boat and a hull assembly for attachment to the pontoon boat are described with reference to the following Figures. The same numbers are used throughout the Figures to reference like features and like components.

DETAILED DESCRIPTION

Figure 1:
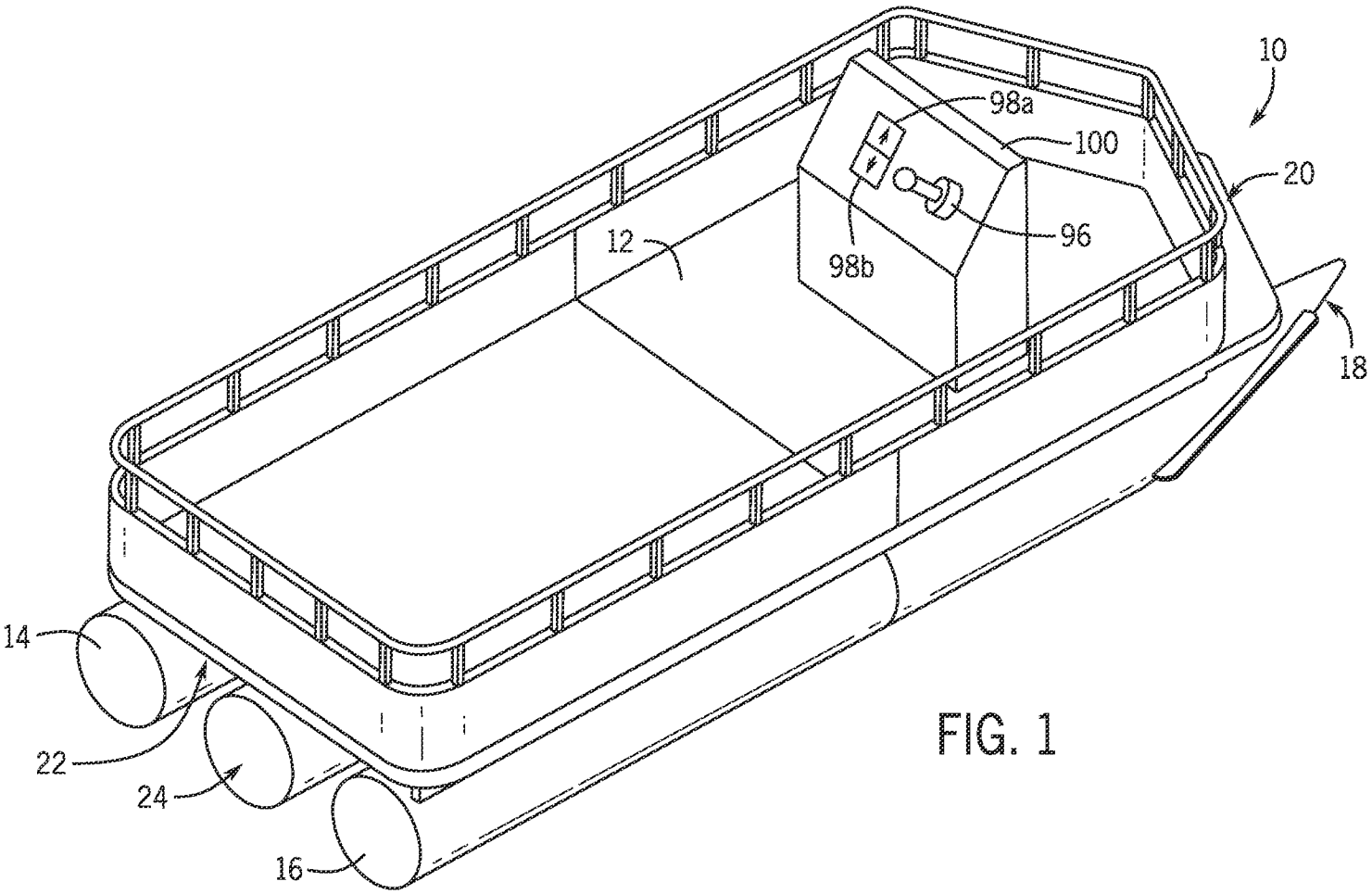
FIG. 1 illustrates a top perspective view of a pontoon boat with a hull assembly according to the present disclosure installed under the deck of the pontoon boat.

FIG. 1 shows a pontoon boat 10 including a deck 12 having two primary hulls 14, 16 attached therebelow. As is known, the primary hulls 14, 16 are generally cylindrical, with narrowed ends 18 located at the bow 20 of the pontoon boat 10 for cutting through the water. The primary hulls 14, 16 can be made of aluminum, fiberglass, or another suitable material and can be hollow or filled with foam, as is known. In some instances, the primary hulls 14, 16 may include lifting strakes (not shown), as is also known. The pontoon boat 10 may be equipped with an outboard motor (not shown) at the stern 22 of the pontoon boat 10, as is known, for propelling the pontoon boat 10 through the water. The outboard motor is not shown here so that an auxiliary hull assembly 24 for the pontoon boat 10 can be seen, which hull assembly 24 will be described further herein below.

Figure 2:
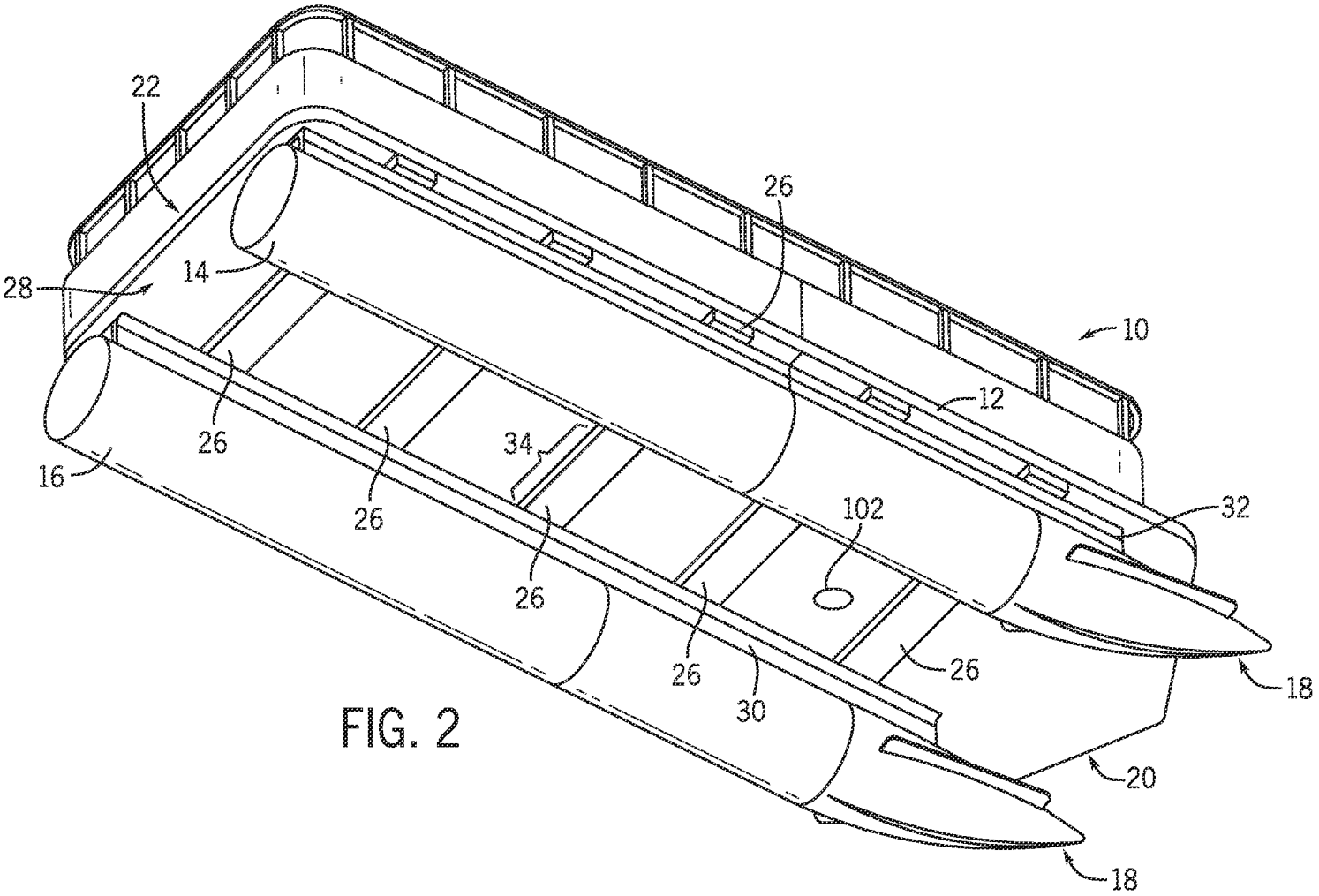
FIG. 2 shows a bottom perspective view of the pontoon boat, before the hull assembly is installed thereunder.

FIG. 2 shows a bottom perspective view of the pontoon boat 10 in order to illustrate where the hull assembly 24 is to be installed. As is typical, a plurality of transverse stringers 26 are attached to an underside 28 of the deck 12 and support the deck 12 and any components installed thereon, such as seats, a helm console 100 (FIG. 1), an upper deck, etc. The stringers 26 are shown here as having rectangular cross-sections for simplicity, but the stringers 26 could have I-shaped cross-sections, U-shaped cross-sections, or other known cross-sections appropriate for supporting the deck 12. The primary hulls 14, 16 are attached to the stringers 26 by way of respective brackets 30, 32. The brackets 30, 32 extend along a majority of the length of the primary hulls 14, 16 and are attached to all the stringers 26. In other examples, individual brackets could be provided at the location of each stringer 26 to attach the primary hulls 14, 16 to each stringer 26. Often, such brackets 30, 32 have M-shaped cross-sections providing four points for connection between the bracket 30 or 32 and the top side of the primary hull 14 or 16, but the brackets 30, 32 could instead be V-shaped or square-shaped in cross-section, by way of non-limiting example. In other examples, the brackets can be U-shaped and extend partially or fully under the primary hulls 14, 16 to support them from their bottom surfaces. The stringers 26 can be welded, bolted, adhered, or otherwise attached to the deck 12, and the brackets 30, 32 can be welded, bolted, adhered or otherwise attached to the stringers 26. The primary hulls 14, 16 can be welded and/or bolted to the brackets 30, 32. Such construction of a pontoon boat is typical, and other types of connections between the deck 12 and primary hulls 14, 16 are known within the art.

The pontoon boat 10 of FIG. 2 has two primary hulls 14, 16 installed along either lateral side below the underside 28 of the deck 12. This leaves a space 34 between the two primary hulls 14, 16 for installation of the auxiliary hull assembly 24. Note that the hull assembly 24 could also be installed on a tritoon (i.e., a boat with three hulls already installed thereon) if the middle hull is first removed from the stringers 26 on which the middle hull is originally installed. In the case that the middle hull is connected to the stringers 26 using bolts, this is a relatively simple process. After the middle hull of the tritoon is removed, the auxiliary hull assembly 24, described below, can be installed in the space 34 between the remaining primary hulls 14, 16.

Figure 3:
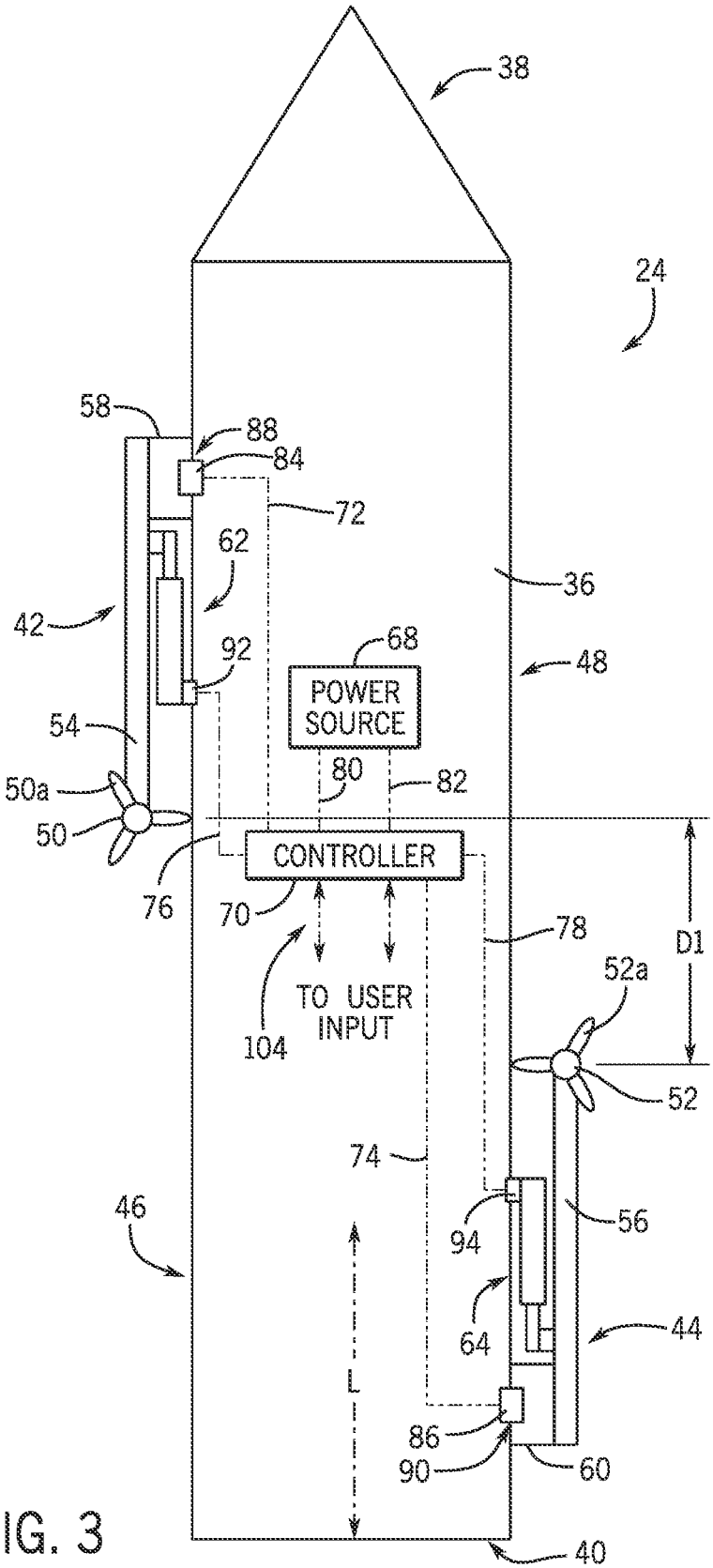
FIG. 3 shows a schematic of a hull assembly according to the present disclosure.

A schematic of the hull assembly 24 is shown in FIG. 3. The hull assembly 24 includes a hull 36 extending in a longitudinal direction L between a front end 38 and a rear end 40. When installed, the front end 38 is to be placed near the bow 20 of the pontoon boat 10, while the rear end 40 is to be placed near the stern 22. Thus, the front end 38 is narrowed to cut through the water. A first thruster assembly 42 is attached to a first lateral side 46 of the hull 36. A second thruster assembly 44 is attached to a second lateral side 48 of the hull 36. The first thruster assembly 42 is attached to the first lateral side 46 of the hull 36 closer to the front end 38 of the hull 36 than to the rear end 40 of the hull 36, and the second thruster assembly 44 is attached to the second lateral side 48 of the hull 36 closer to the rear end 40 of the hull 36 than to the front end 38 of the hull 36. Note that the designation of the thruster assemblies 42, 44 as "first" and "second" is arbitrary, and the thruster assembly 42 could instead be closer to the rear end 40 of the hull 36, while the thruster assembly 44 could instead be closer to the front end 38 of the hull 36. In this example, the first lateral side 46 of the hull 36 is opposite the second lateral side 48 of the hull 36; however, the thruster assemblies 42, 44 could be installed on the same lateral side of the hull 36 as one another (i.e., the first and second lateral sides are the same side of the hull 36).

Figure 4:
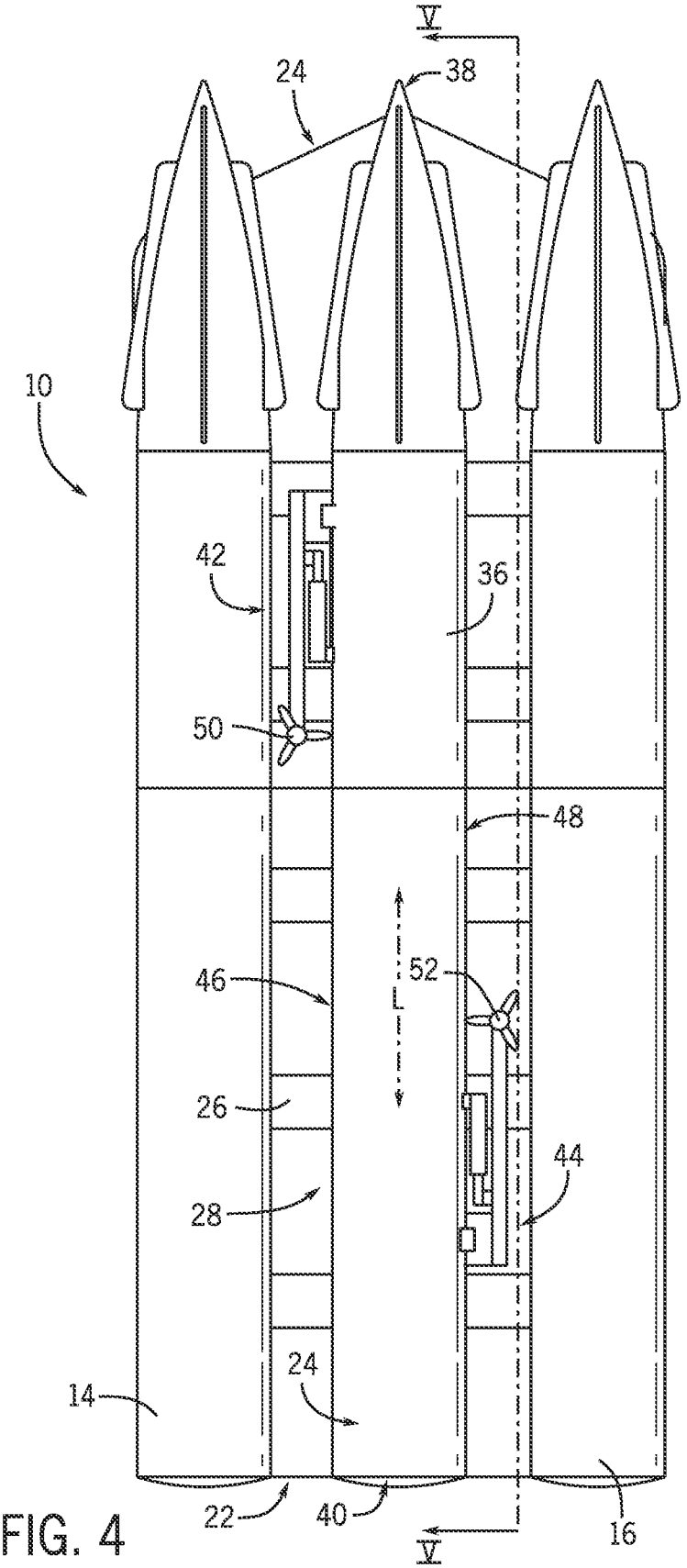
FIG. 4 illustrates a bottom view of the pontoon boat with the hull assembly installed thereon.

FIG. 4 shows the hull assembly 24, complete with thruster assemblies 42, 44, installed on the pontoon boat 10. It can be seen that the hull assembly 24 is sized to fit within the space 34 between the primary hulls 14, 16. The length of the hull 36 of the hull assembly 24 in the longitudinal direction L is approximately the same as the length of the primary hulls 14, 16. In other examples, the hull 36 can be a few inches to a foot shorter than the primary hulls 14, 16. The width of the hull 36 when viewed from below is such that the hull 36 and the thruster assemblies 42, 44 can fit within the space 34 between the primary hulls 14, 16 when the thruster assemblies 42, 44 are in stowed positions alongside the lateral sides 46, 48 of the hull 36, which stowed positions will be described further herein below. The thruster assemblies 42, 44 are accordingly sized to fit within the spaces between the lateral side 46 of the hull 36 and the facing lateral side of the primary hull 14, and between the lateral side 48 of the hull 36 and the facing lateral side of the primary hull 16.

Figure 5:
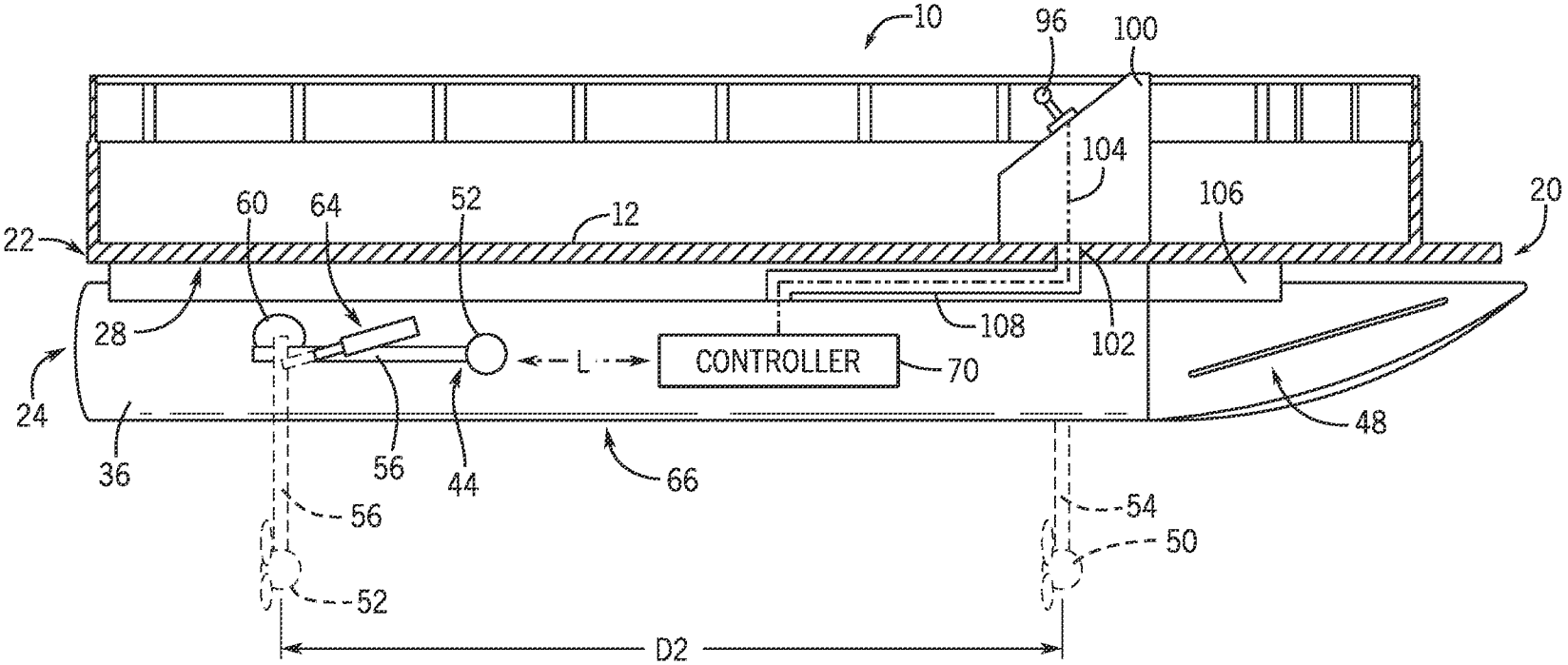
FIG. 5 is a cross-sectional view through the pontoon boat, taken along the line V-V in FIG. 4.

By comparison of FIGS. 3 and 5, it can be seen that the first and second thruster assemblies 42, 44 include respective thrust units 50, 52 that are each movable between a deployed position (FIG. 5, as shown in phantom) and a stowed position (FIG. 3). Each of the first and second thruster assemblies 42, 44 further comprises a shaft 54, 56 attached to the thrust unit 50, 52; a joint 58, 60 coupling the shaft 54, 56 to the hull 36 in a movable manner; and an actuator 62, 64 configured to move the shaft 54, 56 with respect to the hull 36 via the joint 58, 60 so as to move the thrust unit 50, 52 between the deployed and stowed positions. Each joint 58, 60 is configured to pivot its respective shaft 54, 56 and thrust unit 50, 52 such that in the stowed position the thrust units 50, 52 are located closer to one another in the longitudinal direction L than in the deployed position (see FIG. 3), and such that in the deployed position the thrust units 50, 52 are located further from one another in the longitudinal direction L than in the stowed position (see FIG. 5, as shown in phantom). For example, as shown in FIG. 3, in the stowed position the thrust units 50, 52 are located at distance D1 from one another, center-to-center. As shown in phantom in FIG. 5, the thrust units are located at distance D2 from one another, center-to-center, where D2 is greater than D1. Additionally, as shown in FIG. 5, the thrust units 50, 52 are located below a bottom surface 66 of the hull 36 when the thrust units 50, 52 are in the deployed position (shown in phantom), and as shown in FIG. 3, the thrust units 50, 52 are located alongside the respective first and second lateral sides 46, 48 of the hull 36 when the thrust units 50, 52 are in the stowed position. Movement of the thrust units 50, 52 between the stowed and deployed positions will be described further herein below.

Returning to FIG. 3, the hull assembly 24 further comprises a power source 68 located within an interior of the hull 36. The power source 68 can be a battery, and in one example is a battery typically known as a marine starting battery. In another example, the power source is a different type of marine battery, a solar battery, or a fuel cell. The hull assembly 24 further comprises a controller 70 located within the interior of the hull 36 and electrically coupled to the power source 68 and to the first and second thruster assemblies 42, 44. First and second electrical connectors 72, 74 respectively connect the first and second thruster assemblies 42, 44 to the power source 68 via the controller 70. In other examples, the controller 70 is located remote from the power source 68, in which case the power source 68 can be directly electrically connected to the first and second thruster assemblies 42, 44 by way of the first and second electrical connectors 72, 74. Third and fourth electrical connectors 76, 78 also connect the controller 70 to the thruster assemblies 42, 44; although in some examples the first and third electrical connectors 72 and 76 and the second and fourth electrical connectors 74 and 78 can be part of multi-wire cables along a portion or all of their lengths. Additional electrical connectors 80, 82 connect the positive and negative terminals on the power source 68 to the controller 70.

The power source 68 and controller 70 can be supported by a platform that is suspended from the inner top surface of the hull 36 or can be supported by a platform that is raised from the inner bottom surface of the hull 36. Preferably, however, some sort of platform or inner container protects the power source 68 and controller 70 from contact with water in case the hull 36 is damaged and water leaks into the hull 36 and pools on the inner bottom surface thereof. The electrical connectors may for similar reasons be suspended above the inner bottom surface of the hull 36, such as by using clips or adhesive. In still another example, the interior of the hull 36 has a box-like structure built into it, which is configured to hold the power source 68 and the controller 70. A watertight access panel or door (not shown) located for example on the top surface of the hull 36 can provide a user with access to the power source 68 and controller 70 for replacement and/or maintenance purposes.

The first and second electrical connectors 72, 74 extend through the first and second lateral sides 46, 48 of the hull 36, respectively. The hull assembly 24 further comprises first and second grommets 84, 86 provided at respective first and second watertight interfaces 88, 90 between the first and second electrical connectors 72, 74 and the first and second lateral sides 46, 48 of the hull 36, respectively. Effectively, these interfaces 88, 90 are holes or apertures cut through the material of the hull 36, through which the electrical connector 72 or 74 is passed and secured in place using the grommet 84 or 86. Waterproof adhesive or potting compound can be provided between the grommets 84, 86 and the electrical connectors 72, 74 and/or between the apertures in the hull 36 and the grommets 84, 86, as needed Similar watertight interfaces with grommets 92, 94 can be provided where the electrical connectors 76, 78 extend through the hull 36 to connect to the actuators 62, 64, respectively.

The controller 70 is configured to be communicatively coupled with a user input device on the pontoon boat 10. For instance, referring back to FIG. 1, the user input device can include a joystick 96 and thruster up/down buttons 98*a*, 98*b* provided at the helm console 100 of the pontoon boat 10. In another example, the joystick 96 is replaced by a keypad, a trackball, or a touchscreen with options for a user to command the thruster assemblies 42, 44. The thruster up and down buttons 98*a*, 98*b* are shown as a switch, but can instead be presented on a keyboard or a touchscreen, which may be the same touchscreen as that presenting the joystick-like directional options to the user.

The user input devices 96 and 98*a*, 98*b* are communicatively coupled to the controller 70 by way of electrical connectors that are routed through the helm console 100 and below the deck 12 to the hull assembly 24. For instance, a hole 102 (FIG. 2) can be drilled through the deck 12 between the stringers 26 to provide for passage of the electrical connectors. FIG. 5 shows schematically how the electrical connectors, collectively shown in electrical cable 104, can be passed through the hole 102 and connected to the controller 70. As was described with respect to the first and second primary hulls 14, 16, the hull assembly 24 further includes a bracket 106 configured to connect the hull 36 to the underside 28 of the deck 12 of the pontoon boat 10. The bracket 106 can be a U-shaped bracket, a square-shaped bracket, a V-shaped bracket, or an M-shaped bracket, as disclosed herein above regarding the brackets 30, 32 and may be welded to the upper surface of the hull 36. The bracket 106 includes an integrated channel 108 for routing the electrical cable 104 from the pontoon boat 10 to the hull 36 of the hull assembly 24. The integrated channel 108 may be a ledge, a conduit, or a series of clips or similar features sized and shaped to hold the electrical cable 104, which may be exposed to the elements if watertight. The integrated channel 108 can be formed as part of the bracket 106 or can be welded, bolted, adhered, or otherwise attached to the bracket 106. Note that although the integrated channel 108 is shown as extending along the bracket 106 in the longitudinal direction L, the integrated channel could instead extend vertically only, directly below the hole 102 in the deck 12, and the electrical cable 104 could be routed mostly through the interior of the hull 36. Grommets or other watertight interfaces may be used where the electrical cable 104 passes through the hole 102 in the deck 12 and through an aperture into the hull 36.

The controller 70 is shown as being approximately halfway between the first and second thruster assemblies 42, 44, but the controller 70 could instead be located directly below the location of the helm console 100, in the interior of the hull 36. In still other examples, the controller 70 is located on the deck 12 of the pontoon boat 10 or in the helm console 100, in which case the electrical cable 104 connects the controller 70 to the power source 68 in the hull 36. It should be understood that the single electrical cable 104 is shown for simplicity; in alternative embodiments, several cables could be used. For example, it may be desirable to connect the power source 68 to the main battery on the deck 12 of the pontoon boat 10 for recharging purposes, in which case additional cables might be required.

The controller 70 is configured to control at least one of: (a) movement of the thrust units 50, 52 between the deployed and stowed positions; and (b) speed and direction of propulsors 50*a*, 52*a* (FIG. 3) of the thrust units 50, 52. The controller 70 is configured to accept input commands from the user input devices 96 and 98*a*, 98*b* so as to control the at least one of: (a) movement of the thrust units 50, 52 between the deployed and stowed positions; and (b) the speed and direction of the propulsors 50*a*, 52*a*. In this context, "at least one of" means "one or both." If the thrust units 50, 52 are steerable, the controller 70 may also be configured to control the steered positions of the thrust units 50, 52 in response to input commands from the user input devices 96 and/or 98*a*, 98*b*. For instance, by pressing the down button 98*b* at the helm console 100, the user can command the controller 70 to activate the actuators 62, 64 to lower the thrust units 50, 52 to the deployed positions shown in phantom in FIG. 5. By pressing the up button 98*a* at the helm console 100, the user can command the controller 70 to activate the actuators 62, 64 to raise the thrust units 50, 52 to the stowed positions shown in FIGS. 3 and 4 and in solid lines in FIG. 5. Although only one thruster up/down switch is shown, separate switches for controlling each of the thruster assemblies 42, 44 can be provided at the helm console 100. When the thrust units 50, 52 are in the lowered/deployed positions, the user can use the joystick 96 to command the controller 70 to activate the motors of the thrust units 50, 52 to turn the propulsors 50*a*, 52*a*. For instance, if the user tilts the joystick 96 to the right, the thrust units 50, 52 may be activated to produce thrust tending to move the pontoon boat 10 to the right, and if the user tilts the joystick 96 to the left, the thrust units 50, 52 may be activated to produce thrust tending to move the pontoon boat 10 to the left. If the user rotates the joystick 96 about a longitudinal axis of its handle, the controller 70 may activate the thrust units 50, 52 to product thrust tending to rotate the pontoon boat 10 in the direction in which the handle of the joystick 96 was rotated. A joystick 96 capable of providing such inputs and a controller 70 capable of interpreting such commands and thereafter controlling the motors of the thrust units 50, 52 are well-known in the art.

The controller 70 may include a computing system that includes a processing system, storage system, software, and input/output interfaces. The processing system can comprise a microprocessor, including a control unit and a processing unit, and other circuitry, such as semiconductor hardware logic, that retrieves and executes software from the storage system. The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

Thus, referring to FIGS. 3 and 5 together, the present disclosure is of a hull assembly 24 for a pontoon boat 10 comprising a hull 36 extending in a longitudinal direction L between a front end 38 and a rear end 40. A first thruster assembly 42 is attached to a first lateral side 46 of the hull 36 closer to the front end 38 of the hull 36 than the rear end 40 of the hull 36. The first thruster assembly 42 includes a first shaft 54, a first joint 58 coupling the first shaft 54 to the hull 36 in a movable manner, a first thrust unit 50 attached to the first shaft 54, and a first actuator 62 configured to move the first shaft 54 and the first thrust unit 50 with respect to the hull 36 via the first joint 58. The first actuator 62 is configured to move the first shaft 54 and the first thrust unit 50 between a stowed position (FIG. 3; FIG. 5 as shown in solid lines), in which the first thrust unit 50 is located alongside the first lateral side 46 of the hull 36, and a deployed position (FIG. 5, as shown in phantom), in which the first thrust unit 50 is located below the bottom surface 66 of the hull 36. The hull assembly 24 further comprises a second thruster assembly 44 attached to a second lateral side 48 of the hull 36. The second thruster assembly 44 includes a second shaft 56, a second joint 60 coupling the second shaft 56 to the hull 36 in a movable manner, a second thrust unit 52 attached to the second shaft 56, and a second actuator 64 configured to move the second shaft 56 and the second thrust unit 52 with respect to the hull 36 via the second joint 60. The second actuator 64 is configured to move the second shaft 56 and the second thrust unit 52 between a stowed position (FIG. 3; FIG. 5 as shown in solid lines), in which the second thrust unit 52 is located alongside the second lateral side 48 of the hull 36, and a deployed position (FIG. 5, as shown in phantom), in which the second thrust unit 52 is located below the bottom surface 66 of the hull 36.

Note that by "alongside," it is meant that the thrust units 50, 52 are above a horizontal plane tangent to the bottom surface 66 of the hull 36. In this stowed position, the shafts 54, 56 may be oriented horizontally, or they may be angled up or down with respect to horizontal. In most examples, the thrust units 50, 52 are out of the water when they are in the stowed position. By "below," it is meant that the thrust units 50, 52 are below the horizontal plane tangent to the bottom surface 66 of the hull 36. It is not necessary that the thrust units 50, 52 are directly below the hull 36 when viewed from above, and indeed, this is not the arrangement shown in FIGS. 3 and 4. Rather, in the deployed position, the thrust units 50, 52 are configured to be in the water, and for thrust efficiency purposes are situated below the bottom surface 66 of the hull 36.

The joints 58, 60 can be any connections appropriate for movably supporting the shafts 54, 56 and thrust units 50, 52 connected thereto with respect to the hull 36. The joints 58, 60 can be pivotable joints, rotatable joints, or sliding joints, by way of non-limiting example. In one particular example, the joints 58, 60 comprise gears that enable pivoting of the shafts 54, 56 with respect to the hull 36 between the stowed and deployed positions, such as shown in U.S. application Ser. No. 17/185,289, filed by the present applicant on Feb. 25, 2021. The contents of the '289 application are hereby incorporated by reference herein in their entirety. The joints 58, 60 can serve as the location for the watertight interfaces 88, 90 between the hull 36 and the electrical connectors 72, 74 providing electrical power and communication to the thrust units 50, 52.

As is known, each thrust unit 50, 52 may include an electric motor within its housing, the output shaft of the electric motor being connected to the propulsor 50*a*, 52*a* to power the propulsor. In one example, the electric motors are DC brushless motors, although many other types of motors could be used, such as any motor known to be appropriate for a trolling motor. The propulsors 50*a*, 52*a* could be propellers, impellers, or other known propulsors capable of producing thrust in water to move a boat. The electrical connectors 72, 74 provide electrical power to electrical wires inside the shafts 54, 56, which electrical wires are connected to the electric motors in the housings of the thrust units 50, 52. The controller 70 can vary the speed of the electric motors and thus the propulsors 50*a*, 52*a* by varying the current provided to the electric motors. In some examples, however, the electric motors only be turned on or off (i.e., they do not have variable speed). The controller 70 can control the direction of the propulsors 50*a*, 52*a* (i.e., whether they turn clockwise or counterclockwise) by controlling the polarity of the applied voltage. In this way, the thrust units 50, 52 can be made to produce thrust in both a port direction and a starboard direction of the pontoon boat 10. In other examples, the propulsors 50*a*, 52*a* may be able to turn in only one direction (clockwise or counterclockwise), and the shafts 54, 56 are steerable so as to direct the thrust to port or starboard.

The actuators 62, 64 may be any actuator suitable for moving the shafts 54, 56 and thrust units 50, 52 connected thereto between the stowed and deployed positions. By way of non-limiting example, the actuators 62, 64 can be electric linear actuators, hydraulic linear actuators, electric rack-and-pinion actuators, electric rotary actuators, or pneumatic actuators, and may be selected based on the type of joints 58, 60 used to connect the shafts 54, 56 to the hull 36. In the present example, the actuators 62, 64 are electric linear actuators with their cylinder ends coupled to the hull 36 by pivotable joints and their rod ends coupled to the shafts 54, 56 by pivotable joints. In one particular example, actuators like that shown in U.S. application Ser. No. 17/185,289 can be used. If electric, the actuators 62, 64 can have their electric motors installed inside or outside the hull 36. If the electric motors are installed outside the hull 36, the grommets 92, 94 allow for the electrical connectors 76, 78 to extend from the hull 36 and connect to the electric motors of the actuators 62, 64 in a watertight manner. The controller 70 can control the actuators 62, 64 by way of communication via the electrical connectors 76, 78, in response to commands from the up/down buttons 98*a*, 98*b*, as described herein above. In other examples, the up/down buttons 98*a*, 98*b* are directly wired to the power source 68 and the actuators 62, 64 and the controller 70 is not required for stowing or deploying the thrust units 50, 52.

As shown and described herein, the joints 58, 60 and actuators 62, 64 are configured to pivot the shafts 54, 56 and thrust units 50, 52 about pivot axes defined by the joints 58, 60 to move the thrust units 50, 52 between the stowed and deployed positions. Additionally, each thruster assembly 42, 44 is a mirror image of the other across both the longitudinal axis and the lateral axis of the hull 36, such that the thrust units 50, 52 are pivoted toward one another and toward the central lateral axis of the hull 36 when moved to the stowed position, and the thrust units 50, 52 are pivoted away from one another and away from the central lateral axis of the hull 36 when moved to the deployed position. This allows the thruster assemblies 42, 44 to be installed much closer to the respective front end 38 and rear end 40 of the hull 36 than if the thrust units 50, 52 were rotated away from the central lateral axis when moved to the stowed positions. If that were the case, and the joints 58, 60 were located at the same positions as shown in FIG. 3, the thrust units 50, 52 might stick out over the front end 38 or rear end 40 of the hull 36 when pivoted to the stowed positions and could be damaged. However, in other examples, the thruster assemblies 42, 44 may be configured such that the joints 58, 60 are sliding joints and the actuators 62, 64 move the shafts 54, 56 vertically up and down with respect to the lateral sides 46, 48 of the hull 36. In general, it is helpful to place the thruster assemblies 42, 44 such that the thrust units 50, 52 are closer to the longitudinal ends 38, 40 of the hull 36 than to the central lateral axis of the hull 36 in the deployed position, as doing so locates the thrust vectors produced by the thrust units 50, 52 at more effective positions for lateral translation and yawing of the pontoon boat.

Furthermore, although the thruster assemblies 42, 44 are shown as being on opposite lateral sides of the hull 36, as noted above, the thruster assemblies 42, 44 could be on the same lateral side of the hull 36 if their dimensions allow for them to be stowed alongside the hull 36 without contacting one another. In the example in which the joints 58, 60 are sliding joints and the actuators 62, 64 move the shafts 54, 56 vertically up and down with respect to the lateral sides 46, 48 of the hull 36, this is clearly not as much of an issue as it might be with the pivotable thruster assemblies 42, 44 shown herein.

The present inventors have realized that having a pre-rigged/wired hull assembly 24, in which a pontoon hull 36 is provided with pre-installed thruster assemblies 42, 44, which are already connected to a power source 68 and optionally a controller 70, is useful for adding thruster capabilities to a pontoon boat 10 that does not yet have thrusters. On a pontoon boat, the hull assembly 24 can be installed in the space 34 between the primary hulls 14, 16 by feeding the electrical cable(s) 104 from the pre-wired/rigged power source 68 and controller 70 through a hole 102 drilled in the deck 12 of the pontoon boat 10. The opposite ends of the electrical cables 104 can be connected to a house power source, the joystick 96, and/or the up/down buttons 98*a*, 98*b* as appropriate. On a tritoon, the middle hull can be removed before this process, as described herein above. The pre-rigged/wired hull assembly 24 can be attached to the existing stringers 26 on the pontoon boat 10 by way of bolting the bracket 106 thereto.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

What is claimed is:

1. A hull assembly for a pontoon boat, the hull assembly comprising:

a hull comprising a tubular main body and extending in a longitudinal direction between a front end and a rear end and configured for coupling to an underside of the pontoon boat;

a first thruster assembly attached to a first lateral side of the hull; and a second thruster assembly attached to a second lateral side of the hull;

wherein the first and second thruster assemblies include respective thrust units that are each movable between a deployed position and a stowed position.

2. The hull assembly of claim 1, further comprising a power source located within an interior of the hull, and first and second electrical connectors respectively connecting the first and second thruster assemblies to the power source.

3. The hull assembly of claim 2, further comprising a controller located within the interior of the hull and electrically coupled to the power source and to the first and second thruster assemblies, the controller being configured to control at least one of:

(a) movement of the thrust units between the deployed and stowed positions; and (b) speed and direction of propulsors of the thrust units.

4. The hull assembly of claim 3, wherein the controller is configured to be communicatively coupled with a user input device on the pontoon boat, and wherein the user input device is configured to input commands to the controller to control the at least one of:

(a) movement of the thrust units between the deployed and stowed positions; and (b) speed and direction of the propulsors of the thrust units.

5. The hull assembly of claim 2, wherein the first and second electrical connectors extend through the respective first and second lateral sides of the hull in a watertight manner.

6. The hull assembly of claim 1, wherein each of the first and second thruster assemblies further comprises a shaft attached to the thrust unit, a joint coupling the shaft to the hull in a movable manner, and an actuator configured to move the shaft with respect to the hull via the joint so as to move the thrust unit between the deployed and stowed positions.

7. The hull assembly of claim 6, wherein each joint is configured to pivot its respective shaft and thrust unit such that in the stowed position the thrust units are located closer to one another in the longitudinal direction than in the deployed position, and such that in the deployed position the thrust units are located further from one another in the longitudinal direction than in the stowed position.

8. The hull assembly of claim 1, further comprising a bracket configured to connect the hull to the underside of the pontoon boat.

9. The hull assembly of claim 1, wherein the thrust units are located below a bottom surface of the hull when the thrust units are in the deployed position, and the thrust units are located alongside the respective first and second lateral sides of the hull when the thrust units are in the stowed position.

10. The hull assembly of claim 1, wherein the first thruster assembly is attached to the first lateral side of the hull closer to the front end of the hull than to the rear end of the hull, and the second thruster assembly is attached to the second lateral side of the hull closer to the rear end of the hull than to the front end of the hull.

11. The hull assembly of claim 1, wherein the first lateral side of the hull is opposite the second lateral side of the hull.

12. A hull assembly for a pontoon boat, the hull assembly comprising:

a hull comprising a tubular main body and extending in a longitudinal direction between a front end and a rear end and configured to be coupled to an underside of the pontoon boat; and a first thruster assembly attached to a first lateral side of the hull closer to the front end of the hull than to the rear end of the hull, the first thruster assembly including a first shaft, a first joint coupling the first shaft to the hull in a movable manner, a first thrust unit attached to the first shaft, and a first actuator configured to move the first shaft and the first thrust unit with respect to the hull via the first joint;

wherein the first actuator is configured to move the first shaft and the first thrust unit between a stowed position, in which the first thrust unit is located alongside the first lateral side of the hull, and a deployed position, in which the first thrust unit is located below a bottom surface of the hull.

13. The hull assembly of claim 12, further comprising a second thruster assembly attached to a second lateral side of the hull, the second thruster assembly including a second shaft, a second joint coupling the second shaft to the hull in a movable manner, a second thrust unit attached to the second shaft, and a second actuator configured to move the second shaft and the second thrust unit with respect to the hull via the second joint;

wherein the second actuator is configured to move the second shaft and the second thrust unit between a stowed position, in which the second thrust unit is located alongside the second lateral side of the hull, and a deployed position, in which the second thrust unit is located below the bottom surface of the hull.

14. The hull assembly of claim 13, wherein the second thruster assembly is attached to the second lateral side of the hull closer to the rear end of the hull than to the front end of the hull.

15. The hull assembly of claim 13, wherein the first and second joints are configured to pivot the respective first and second shafts and thrust units such that in the stowed position the first and second thrust units are located closer to one another in the longitudinal direction than in the deployed position, and in the deployed position the first and second thrust units are located further from one another in the longitudinal direction than in the stowed position.

16. The hull assembly of claim 13, further comprising a power source located within an interior of the hull, and first and second electrical connectors respectively connecting the first and second thruster assemblies to the power source.

17. The hull assembly of claim 16, further comprising a controller located within the interior of the hull and electrically coupled to the power source and to the first and second thruster assemblies, the controller being configured to control at least one of:

(a) movement of the first and second thrust units between the deployed and stowed positions; and (b) speed and direction of propulsors of the first and second thrust units.

18. The hull assembly of claim 17, wherein the controller is configured to be communicatively coupled with a user input device on the pontoon boat, and wherein the user input device is configured to input commands to the controller to control the at least one of:

(a) movement of the first and second thrust units between the deployed and stowed positions; and (b) speed and direction of the propulsors of the first and second thrust units.

19. The hull assembly of claim 16, wherein the first and second electrical connectors extend through the first and second lateral sides of the hull, respectively, in a watertight manner.

20. The hull assembly of claim 12, further comprising a bracket configured to connect the hull to the underside of the pontoon boat.

* * * * *